United States Patent [19]

Stevenson

[11] 4,399,946

[45] Aug. 23, 1983

[54] METHOD AND APPARATUS FOR PRODUCING CEMENT OR PLASTER

[75] Inventor: Christopher Stevenson, Bromyard, England

[73] Assignee: Mono Oakes Limited, Macclesfield, England

[21] Appl. No.: 225,245

[22] Filed: Jan. 15, 1981

[30] Foreign Application Priority Data

Jan. 22, 1980 [GB] United Kingdom ..... 8002136

[51] Int. Cl.[3] ..... B02C 18/06; B02C 23/36

[52] U.S. Cl. ..... 241/21; 241/46.06; 241/236

[58] Field of Search ..... 241/21, 46.02, 46.06, 241/222, 224, 236, 27, 101 B

[56] References Cited

U.S. PATENT DOCUMENTS

| | | | |
|---|---|---|---|
| 1,850,308 | 3/1932 | Saunders | 241/21 X |
| 2,144,254 | 1/1939 | Breerwood | 241/21 X |
| 2,801,932 | 8/1957 | Witt | 241/21 |
| 3,682,396 | 8/1972 | Whitney et al. | 241/236 X |
| 3,931,936 | 1/1976 | Petry et al. | 241/236 X |
| 4,046,324 | 9/1977 | Chambers | 241/46.06 |

FOREIGN PATENT DOCUMENTS

| | | |
|---|---|---|
| 2543379 | 3/1977 | Fed. Rep. of Germany . |
| 283347 | 6/1952 | Switzerland . |

*Primary Examiner*—Mark Rosenbaum
*Attorney, Agent, or Firm*—Fleit, Jacobson & Cohn

[57] ABSTRACT

A method and apparatus for forming a cement or plaster slurry, for example, for use in mines, in which bags of cement or plaster are fed into a substantially closed chamber, are ruptured, and water is fed into the chamber at a controlled rate. The resulting mixture is fed into a macerator which serves to comminute the bag material and to mix the cement or plaster which is then fed into a pump, preferably a positive displacement pump, such as a helical gear pump and is thus pumped on to the point of use.

11 Claims, 2 Drawing Figures

METHOD AND APPARATUS FOR PRODUCING CEMENT OR PLASTER

Figure 1:
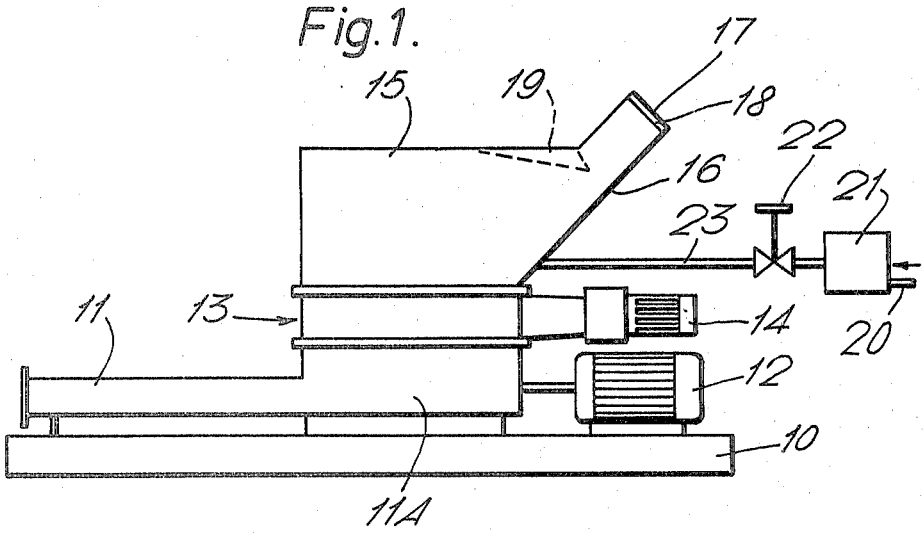

The present invention relates to a method and apparatus for forming a cement or plaster slurry.

It is a common expedient in mines, such as coal mines, to produce a cement or plaster slurry, and to line the walls of the shafts of the mine with this slurry. This can have the effect of sealing the walls against seepage from water, and, more importantly, to prevent the passage of air through the walls of the tunnels. In most mines, ventilating air is forced down one tunnel and back down another tunnel. It is important, therefore, that there should be no flow path for the air other than at the mining face, because this will cause a bypass, thus reducing the ventilation provided.

Conventionally, the cement has been mixed at or near the point of use, by feeding it into a wide mouthed helical gear pump, together with water, and pumping the resulting slurry to the point of use. In order to do this, the cement bags are opened and are tipped into the wide mouthed helical gear pump. It has been found that this produces a considerable amount of cement (or plaster) dust which is a health hazard. Furthermore, a large number of empty cement bags are produced and this produces a fire hazard. These bags, of course, have to be removed and disposed of through the normal waste-collecting channels.

It is now proposed, according to the present invention, to provide a method of forming a cement or plaster slurry, said method comprising feeding bags of cement or plaster into a substantially closed chamber, rupturing the bags, feeding water into the chamber at a controlled rate, feeding the water, the cement or plaster and the bag into a macerator, to comminute the bag material and to mix the cement or plaster and pumping the resulting product to a point of use. According to this method, no dust is produced, because the whole bag is fed into a substantially closed chamber. Furthermore, no empty cement or plaster bags are left, since these are comminuted in the macerator and become mixed up in the cement or plaster slurry. It has been found that the presence of the fibres of the bag material, which is usually paper, have little or no harmful effect on the resulting slurry.

The bag may be ruptured by passing it relative to a slitting knife in the chamber in a simple structure.

The product is preferably pumped on which a positive displacement pump such as a helical gear pump.

The invention also provides an apparatus for forming a cement or plaster slurry, said apparatus comprising a substantially closed chamber, means permitting the bags of cement or plaster to be fed into said chamber, means for rupturing the cement or plaster bar within the chamber, a water inlet to said chamber, means for feeding water at a controlled rate into said chamber via said water inlet, an outlet to said chamber connected to the inlet of a macerator and a pump having its inlet connected to the outlet of the macerator.

The means which permit the bags of cement or plaster to be fed into the chamber may comprise a dust flap, similar to a conventional letterbox flap, which covers the inlet to the chamber.

In an advantageous construction, the macerator comprises a housing having a pair of contra-rotating parallel shafts mounted therein, each shaft carrying alternate-toothed cutters and spacers, the cutters of one shaft interfitting with those of the other shaft and moving in close peripheral proximity to the spacer of the other shaft. A macerator of this type is disclosed in U.S. Pat. No. 4,046,324.

The chamber is preferably mounted above the macerator and the macerator above the inlet to the pump, whereby the cement or plaster and the water flow by gravity through the macerator.

Figure 2:
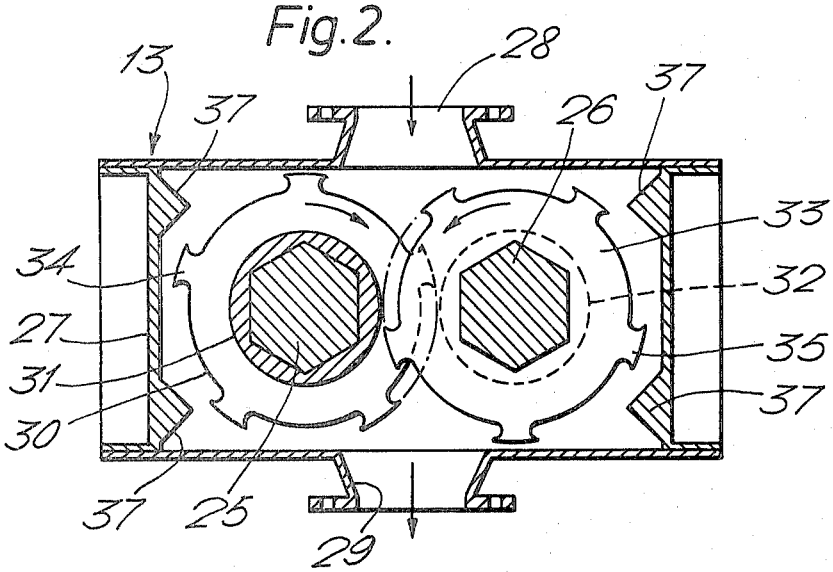

In order that the present invention may more readily be understood, the following description is given, merely by way of example, reference being made to the accompanying drawings, in which:

FIG. 1 is a schematic front elevation of an apparatus for carrying out the method of the invention; and FIG. 2 is an enlarged side elevational view of the macerator used in the apparatus of FIG. 1.

Referring to FIG. 1, the apparatus comprises a base 10 upon which is mounted a helical gear pump 11 having a wide mouthed auger portion 11A. Both the auger and the rotor of the helical gear pump are driven by a motor 12 which is also mounted on the base 10.

The wide mouth of the auger portion 11A serves to support a macerator 13, which is driven by a second motor 14. Details of the construction of the macerator 13 are given below in the description, with reference to FIG. 2. Located on top of the macerator is a chamber or hopper 15 having a sloping wall 16 and an inlet 17 which is closed by a flap 18. Located above the sloping wall 16 is a shaft slitter knife 19.

Finally, the apparatus includes a water feed supply 20 which is connected, via a water flow meter 21 and a control valve 22 to an inlet pipe 23 which enters the housing 15 near the lower end of the sloping wall 16.

Referring now to FIG. 2, it will be seen that the macerator indicated by the general reference numeral 13 includes two contra-rotating shafts 25 and 26 mounted in a generally rectagular housing 27. A housing is provided with an inlet 28 at the top and an outlet 29 at the bottom.

Mounted on the shaft 25 are alternate cutters 30 and spacers 31 whilst on the shaft 26 are mounted alternate spacers 32 and cutters 33 interfitting with the spacers and cutters of the shaft 25. It will be seen that the teeth 34 of the cutter 30 are each symmetrical and are spaced a small distance from the space 32 and the shaft 26. Similarly, the interfitting cutters 33 have their teeth 35 spaced a small distance from the periphery of the spacers 31 and the shaft 25. This arrangement gives a fine comminuting action on material fed in to the inlet 28 and gravity and the rotation of the shafts (which is indicated by the arrows) causes the material to be mixed and comminuted and forced out through the outlet 29. It will be seen that the housing includes four inwardly extending projections 37 which conform to the shape of the teeth of the cutters and this assists in the comminuting action.

In use, for example, to provide a surfacing of the walls of a mine tunnel, the apparatus is mounted in the mine tunnel and the water inlet 20 is connected to a suitable water supply. Bags of cement or plaster, depending on the task to be carried out, are fed in through the flap 18 into the inlet 17 and slide down the guide means or inclined wall 16. Slitting knife 19 will rupture the bag, which is usually made of paper. The bag will continue to slide down the inclined wall 16 and water is fed in at a controlled rate into the chamber 15. The water, the cement or plaster, and the bag itself are drawn into the macerator 13 which serves to mix the cement or plaster with the water, and also finally to comminute the bag material, which is usually paper. While paper is the most common material for cement or plaster bags, it is believed that the method of the invention using this apparatus would be equally suitable if plastics material bags were used.

The mixed cement or plaster, together with the finely divided bag material, is then taken up by the auger portion 11A of the helical gear pump 11 which will simply pump the material onto the point of use.

It will be appreciated that there is no dust hazard produced in this method because the bag is opened in the substantially enclosed chamber 15. Furthermore, there will be no creation of a large quantity of empty cement or plaster bags, since these are simply chopped up in the macerator and form part of the resulting slurry.

I claim:

1. An apparatus for forming a cement or plaster slurry and for pumping the slurry onward, the apparatus comprising:

a. a substantially closed chamber for receiving bags of cement or plaster, said chamber having a top and a bottom;

b. a macerator within said closed chamber for macerating bags of cement or plaster within said chamber and for forming a slurry of cement or plaster, macerated bag material, and water;

c. means at the top of said chamber for permitting full bags of cement or plaster to be fed into said chamber, while maintaining said chamber substantially closed;

d. means for introducing water into said chamber;

e. means for controlling the rate of introduction of water into said chamber;

f. an outlet of the chamber located at the bottom thereof;

g. a positive displacement pump mounted below said outlet of the chamber; and h. an inlet to said pump connected to said outlet of the chamber so that the resulting slurry of cement or plaster, macerated bag material and water flows by gravity into said pump inlet and the resulting slurry is pumped to a point of use by said pump.

2. The apparatus of claim 1, further comprising means within the substantially closed chamber for rupturing full bags.

3. Apparatus as claimed in claim 2, wherein the means for rupturing the cement or plaster bag comprise a slitting knife in said chamber.

4. The apparatus of claim 1, further comprising guide means within said closed chamber for guiding movement of bags from the top of said chamber to said macerator.

5. Apparatus as claimed in claim 1, wherein said pump is a helical gear pump.

6. Apparatus as claimed in claim 1, wherein the means for permitting bags of cement or plaster to be fed into said chamber comprise an inlet to said chamber and a dust flap covering said inlet.

7. Apparatus as claimed in claim 1, wherein said macerator comprises a housing, a pair of contra-rotating parallel shafts mounted in said housing, alternate toothed cutters and spacers carried on each shaft, the cutters of one shaft interfitting with those of the other shaft and moving in close peripheral proximity to the spacer of the other shaft.

8. A method of forming a cement or plaster slurry, said method comprising the steps of:

(a) feeding bags of cement or plaster into a substantially closed chamber;

(b) rupturing the bags;

(c) feeding water into the chamber at a controlled rate;

(d) feeding the water, the cement or plaster and the bag into a macerator, to comminute the bag material and to mix the cement or plaster; and (e) pumping the resulting product to a point of use.

9. A method as claimed in claim 8, wherein the bag is ruptured by passing it relative to a slitting knife in said chamber.

10. A method as claimed in claim 8, wherein the resulting product is pumped to the point of use by a helical gear pump.

11. In a method of forming a cement or plaster slurry, in which the cement or plaster and water are mixed and pumped to the point of use, the improvement comprising:

supplying the cement or plaster in bags;

introducing the bags of cement or plaster into a macerator;

macerating the material of the bags with the contents of the bags, with the material of the bags being included in the mixture of cement or plaster and water to form a slurry; and pumping the slurry to a point of use.

* * * * *